United States Patent [19]

Kulick et al.

[11] 3,975,214

[45] Aug. 17, 1976

[54] TANNIN CONTAINING COMPOSITIONS

[75] Inventors: Leonard Kulick, Ferndale; Karim I. Saad, Sterling Heights, both of Mich.

[73] Assignee: Oxy Metal Industries Corporation, Warren, Mich.

[22] Filed: July 26, 1974

[21] Appl. No.: 492,121

Related U.S. Application Data

[63] Continuation-in-part of Ser. No. 292,714, April 24, 1972, abandoned.

[52] U.S. Cl. ..... 148/6.15 R; 148/6.15 Z; 148/6.14 R

[51] Int. Cl.[2] ..... C23F 7/08

[58] Field of Search ..... 148/6.15 R, 6.15 Z, 148/6.14; 117/49; 8/94.32

[56] References Cited

UNITED STATES PATENTS

| | | | |
|---|---|---|---|
| 870,937 | 11/1907 | Coslett | 148/6.24 |
| 1,303,627 | 5/1919 | Baines | 148/6.15 Z |
| 2,854,368 | 9/1958 | Shreir | 148/6.15 R |

FOREIGN PATENTS OR APPLICATIONS

| | | | |
|---|---|---|---|
| 1,192,487 | 6/1965 | Germany | 148/6.15 |

OTHER PUBLICATIONS

Cristi, S., Maren, Chem. Abstracts, vol. 71, 126055f, 1969.

Emery, Chem. Abstracts, vol. 65, 1966, 11873.

Translation of German Patent 1192487.

*Primary Examiner*—Ralph S. Kendall

*Assistant Examiner*—Charles R. Wolfe, Jr.

*Attorney, Agent, or Firm*—Arthur E. Kluegel; Richard P. Mueller; Bertram F. Claeboe

[57] ABSTRACT

Disclosed is a process for applying a tannin containing post-treatment composition over zinc phosphate conversion coatings on metallic surfaces so as to provide an improved base for paint, lacquer, varnish, or similar organic finishes. Also disclosed are a process for the transport and application of the tannin composition and a process for preparing a metallic surface for electrodeposition painting.

21 Claims, No Drawings

TANNIN CONTAINING COMPOSITIONS

CROSS-REFERENCE TO RELATED APPLICATION

This application is a continuation-in-part of U.S. Ser. No. 292,714 filed Apr. 24, 1972, now abandoned.

BACKGROUND OF THE INVENTION

In order to provide improved appearance, longer life, and increased reliability for metal based consumer and industrial products, it has become an accepted practice to conversion coat metallic surfaces prior to the application of a paint, lacquer, or oil. The conversion coated metallic surface is in turn treated with a post-treatment to impart further humidity and corrosion resistance thereto. The treatment or final rinse frequently is a chromium containing composition such as described in U.S. Pat. Nos. 3,222,226, and 2,970,935. The use of heavy metals such as chromium in metal treating lines may result in pollution.

Many chromium containing compositions have further side effects of leading to blistering of the final organic film under conditions of high humidity at areas where the posttreatment solution can concentrate before drying. One method of overcoming this problem is to water rinse (preferably with deionized water) the work before painting. This is especially desirable before electropainting where the paints are water based and soluble contaminants can unbalance the paint. Many chromium containing post-treatments wash off in this water rinse thus losing their ability to inhibit paint loss due to under paint corrosion.

Therefore, a post-treatment which will eliminate heavy metal ions such as chromium, and which will also allow water rinsing without decrease in corrosion resistance is desirable.

SUMMARY OF THE INVENTION

The invention described herein consists of an improved process for imparting additional corrosion and humidity resistance to zinc phosphate conversion coated metallic surfaces by contacting the surface with an aqueous solution consisting essentially of a vegetable tannin and having a pH of less than 6. The invention also consists of an improved process for preparing a metal for electrodeposition painting and a process for transport and application of the tannin solution.

DESCRIPTION OF THE PREFERRED EMBODIMENTS

The invention described in the present case is directed toward improving the corrosion and humidity resistance of zinc phosphate conversion coated metallic surfaces, without subtracting from the ability of the treated surface to allow satisfactory adhesion of a decorative organic coating. The metallic surfaces that may be employed in the present invention are normally steel, i.e., cold rolled, ground, pickled, hot rolled, etc.; galvanized steel and aluminum, i.e., metallic surfaces containing zinc, iron, or aluminum.

In forming conversion coatings on these metallic surfaces, various treatment steps are employed, such as described in: (1) Metal Handboodk, Volume 2, 8th Edition, Pages 529-547, American Society for Metals, (2) J. I. Maurer, "Preparation of Metal Surface for Organic Finishes" - American Society of Tool and Manufacturing Engineers, Paper FC 68-652.

The steps that are normally employed are:

1. Cleaning
2. Water Rinsing
3. Forming of a conversion coating by contacting the surface with a suitable coating composition.
4. Water Rinsing In the act of preparing metal to receive paint, it is widely understood that the application of a dilute chromium containing solution to the zinc phosphate conversion coating improves that coating as a base for paint both with respect to corrosion and humidity resistance of the painted surface.

Where conventional painting is employed, the surface is normally dried following the post-treatment. Where electrodeposition painting is employed, drying is not normally necessary but the post-treated surface must be rinsed with deionized water to minimize contamination of the electrodeposition bath. In the past, some chromium post-treatments have had the disadvantage that a subsequent deionized water rinse would adversely affect the humidity and corrosion resistance of the subsequently electropainted surface. This disadvantage was most critical in the case of electroplating (with deionized water rinse). Example 2 demonstrates that acceptable results may be obtained with the tannin post-rinsed despite the deionized water rinse.

The use of tannins or tannic acid as a treatment for bare or corroded metallic surfaces has been described in U.S. Pat. Nos. 1,798,218; 24,604; 566,037; 750,986; 1,079,453; 1,501,425 (gallic acid); 1,817,174; 3,547,710; 3,578,508; 2,311,563, and 2,854,368. The results obtained with such treatments are significantly ineffective as a means for imparting long term corrosion resistance to painted metallic surfaces. When the solution of U.S. Pat. No. 2,854,368 is used as a post-rinse on a zinc phosphate coating, it strips the conversion coating from the metal surface.

Typical of the conversion coating compositions that may be employed in the present invention are those known as zinc phosphatizing compositions. Examples of such compositions are described in U.S. Pat. No. 2,835,617, the contents of which is hereby incorporated by reference.

The natural tannin containing compositions referred to in the summary of invention hereinabove are polyphenolic compositions extracted from various plants and trees. Natural tannin extracts have been described in U.S. Pat. No. 2,854,368. A tannin is described as a substance which will impart a tan to leather.

One of the primary advantages of post-treating conversion coatings is to minimize or eliminate blister formation in the paint that can occur under conditions of high humidity when water condenses on the painted ware. This problem is particularly evident when painting galvanized surfaces.

Most tannin extracts used under the proper conditions of pH and concentration are effective in minimizing or eliminating this humidity failure. However, only certain tannins such as quebracho or tannic acid (National Formulary) were found to significantly increase the corrosion resistance of the painted conversion coated metals.

Natural tannin extracts are polyphenolic substances which can be classified according to their chemical properties as: (a) hydrolyzable tannins; (b) condensed tannins; and (c) mixed tannins containing both hydrolyzable and condensed tannins.

Hydrolyzable tannins yield water soluble products upon hydrolysis with boiling dilute mineral acids whereas under these conditions complex tannin extracts form precipitates known as "tanners red" or phlobaphene. This classification somewhat corresponds to the "cathechol tannins" (condensed) and "pyrogallo tannins" (hydrolyzable). Examples of suitable vegetable tannins are Chinese gall (tannic acid), myrobalan, chestnut wood, divi-divi, valonia, summac, chinchona, mangrove, wattle, eucalyptus, cutch, quebracho, hemlock, mimosa, oak, gambier.

The preferred tannin materials are those that contain the tannin extract from naturally occurring plants and trees, normally referred to as vegetable tannins.

Preferred extracts are those selected from the group consisting of quebracho and tannin acid (National Formulary). The most preferred extract is quebracho extract.

Tannin extracts are also available as a sulfited composition whereby the extract is treated with a sulfiting composition to improve the water solubility of the extract. It has been found that the non-sulfite containing compositions are preferred as embodiments.

It has also been found that when the tannin extracts are subjected to NMR (nuclear magnetic resonance) analysis, the preferred tannins have an aromatic/alkyl ratio greater than about 2, preferably about 2 to about 5. By "alkyl" is meant the portion of the molecule consisting of saturated aliphatic groups. These groups are detected by NMR analysis as the protons or hydrogen atoms from the —CH or —$CH_2$ portions of the sucrose fragments of the tannins. By "aromatic" is meant the hydrogen or proton attached to the carbon atom is a benzene ring in the polyphenolic portion of the tannin.

The amount of tannin containing composition (based on 100% natural tannin extract) that may be used in the post-treatment step of the invention is about 0.1 to 10 g/l, and even preferably about 0.25 to about 2 g/l.

The bath temperature for the tannin containing composition may range from about ambient to about 200°F.

The pH of the bath for the tannin containing composition should be less than 6, preferably from 3.0 to 6.0 and most preferably about 4.5.

A desirable tannin concentrate composition which can be used for transporting and formulating the bath for the post-treatment of conversion coatings is one that is aqueous and contains about 5 to 60% by weight, preferably 15 to 35% by weight tannin (based on tannin extract). It has been found that this material may be directly added to the bath composition without significant time delays. The difficulty with such a concentrated composition is that the tannin may precipitate during shipping. It has been found that the tannin extract can be solubilized by adjusting the pH of the concentrate composition with an alkali metal hydroxide such as NaOH to an alkaline pH, preferably about 7.5 to about 10, and even more preferably about 8. In this manner, the tannin may be shipped as a stable aqueous concentrate. Later acidification to working bath conditions does not affect the activity of the tannin.

Other ingredients may be added to the tannin concentrate composition such as aluminum fluoride providing the additional ingredients do not tend to increase the precipitation of the tannin, as does phosphoric acid, or do not inhibit the desirable corrosion and humidity resistance properties produced of the final compositions.

The following examples illustrate the invention in greater detail, but it is to be understood that the specific composition, condition of treatment and products are given for purposes of illustration only, and are not intended to set forth the definitive limits of the invention herein.

With respect to the data for salt spray and humidity, it should be noted that requirements vary by industry and manufacturer. Salt spray results exceeding 2—2 for 240 hours are generally unacceptable to Ford Motor Co.

EXAMPLE 1

A solution was prepared in a five gallon laboratory spray tank which consisted of a solution of a ½ ounce per gallon of a commercial surface conditioning cleaner and heated to 150°F. A second solution was prepared which consisted of a zinc phosphating composition containing 1.5 g/l zinc ions, 6.4 g/l phosphate ions, 0.11 g/l nitrile ion, 0.5 g/l nickel ions and 0.4 g/l fluoride ions and heated to 150°F. Four by twelve inch minimum spangle commercial hot dip galvanized (GALV.) panels, temper rolled one percent and four by twelve inch SAE 1010, cold rolled mild steel (CRS) panels were sprayed in the sequence one minute in the cleaner, one-half minute fresh warm water rinse in an auxiliary spray tank, one minute in the phosphating bath, one minute in cold water spray rinse, and finally one-half minute in a five gallon spray tank wherein was built the post-treatment composition of the present invention by dissolving nineteen grams of the tannin extract in the five gallons of water in the tank and adjusting the pH of the solution to 4.5 with reagent grade hydrochloric acid. Following this treatment, the panels were dried in a circulating oven for five minutes at 275°F, and air cooled. Control panels were prepared by the same sequence except that they were oven dried after the rinse following the zinc phosphating step, or alternatively post-treated by immersion in a commercial post-treatment consisting of 0.04% chromic acid at a pH of 4, and oven dried.

These panels were then painted with an automative body system consisting of an epoxy primer, an epoxy guide coat, and two coats of an enamel top coat to a total film build of 2¼- 3 thousands of an inch.

They were then subjected to either the standard ASTM B117-61 salt spray test or the ASTM Standard 2247-64T humidity test. Results are tabulated along with the tannin extract used for the test according to the standard system. Therein humidity blisters are rated F for few, M for medium, D for dense, and from 9 for very small to 1 for very large; 10 indicates no blistering. Salt spray panels are rated in terms of the amount of loss of paint from a scribe in 1/16 inch increments. Thus 0 means less than 1/16, and 0–2$^s$ means essentially no creepage except in one or two spots for a distance of 2/16 inch. N indicates no loss of paint. These results are tabulated in Table I.

TABLE I

| Rinse | Metal | 336 Hours Salt Spray | 336 Hours Humidity |
|---|---|---|---|
| Control - Commercial Chrome Rinse | CRS | 0–1 | VF8 |
| Control - Commercial Chrome Rinse | Galv. | 2–5 | D-9 |
| Control - Deionized Water | CRS | 3–4 | 10 |
| Control - Deionized Water | Galv. | 7–9 | D-8 |
| Control - Tap Water | CRS | 3–4 | 10 |
| Control - Tap Water | Galv. | 7–9 | D-6 |
| Tannic Acid (NF- | | | |

TABLE I-continued

| Rinse | Metal | 336 Hours Salt Spray | 336 Hours Humidity |
|---|---|---|---|
| Fluffy Grade from Merck) | CRS | 0–1 | 10 |
| Tannic Acid (NF-Fluffy Grade from Merck) | Galv. | N | 10 |
| Quebracho Extract (Non Sulfite - Trask) | CRS | 1–3 | 10 |
| Quebracho Extract (Non Sulfite - Trask) | Galv. | N | 10 |

These results show that with many tannin materials corrosion resistance as represented by salt spray resistance are better than with a tap water final rinse and approaches the results obtained with conventional dilute chromium containing post-treatments. The humidity results are consistently better than standard post-treatments.

EXAMPLE 2

SAE 1010 cold rolled steel panels were coated as described in Example 1. The post-treatments employed were 1 g/l quebracho adjusted to a pH of 4.5 with phosphoric acid and a trivalent chromium post-treatment containing 0.02% by weight trivalent chromium and 0.04% by weight hexavalent chromium at a pH of 4.3 as described in U.S. Pat. No. 3,279,958. This chrome containing post-treatment may be used with electrodeposited paints because it can be rinsed with deionized water (DIW) to remove soluble materials from the conversion coated work without harming corrosion and humidity resistance after painting, thus avoiding the contamination of the water based paint. Further panels were merely DIW water rinsed after the conversion coating step. One set was air dried and the other oven dried at 275°F. for 5 minutes. These panels were electropainted with two commercial electroprimers - Forbes ED 1124 and Forbes ED 2000, and exposed to the ASTM B117-61 as described above for two weeks. The results are shown in Table 2.

TABLE 2

| | Rinse | Drying | Paint | 336 Hours Salt Spray |
|---|---|---|---|---|
| 1a | Quebracho & DIW | Air | ED2000 | 1–1 |
| 1b | Chrome & DIW | Air | ED2000 | 1–2 |
| 1c | DIW | Air | ED2000 | 3–4 |
| 2a | Quebracho & DIW | Oven | ED2000 | 0–1 |
| 2b | Chrome & DIW | Oven | ED2000 | 1–1 |
| 2c | DIW | Oven | ED2000 | 0–1 |
| 3a | Quebracho & DIW | Air | ED1124 | 0–1 |
| 3b | Chrome & DIW | Air | ED1124 | 1–3 |
| 3c | DIW | Air | ED1124 | 1–4 |
| 4a | Quebracho & DIW | Oven | ED1124 | 0–1 |
| 4b | Chrome & DIW | Oven | ED1124 | 0–1 |
| 4c | DIW | Oven | ED1124 | 1–4 |

These results show that the tannin containing post-treatments have the further advantage that they do not lose their ability relative to chrome when the post treatment is deionized water rinsed in order to remove all soluble materials capable of contaminating further processing solutions such as water based electrophoretic paints.

EXAMPLE 3

Minimum spangle temper rolled commercial hot dip galvanized panels and SAE 1010 cold rolled steel panels were conversion coated as in Example 1.

They were post-treated with a quebracho extract solution and adjusted with phosphoric acid to a pH of 4.5 applied by spray with the concentration varied from 1/4 g/l to 1 g/l. Controls post-treated with the same commercial chromium-containing post-treatment described in Example 1 were also prepared. All panels were oven dried 5 minutes at 275°F and painted with the automotive body system described in Example 1. The results of the salt spray and humidity tests are given in Table 3.

TABLE 3

| Rinse | CRS Salt Spray | CRS Humidity | GALV. Salt Spray | GALV. Humidity |
|---|---|---|---|---|
| Control - Commercial Chrome | 0–1[s] | VF 9 | N | 10 |
| Quebracho pH 4.5 $H_3PO_4$ ¼ g/l | 1–3 | 10 | N | 10 |
| Quebracho pH 4.5 $H_3PO_4$ ½ g/l | 1–1 | 10 | N | 10 |
| Quebracho pH 4.5 $H_3PO_4$ 1 g/l | 0–1 | 10 | N | 10 |

This experiment indicates that the concentration of the tannin containing post-treatment can be varied and still obtain improved corrosion and humidity resistance of conversion coated metal surface.

EXAMPLE 4

Cold rolled SAE 1010 steel panels and minimum spangle temper-rolled commercial hot dipped galvanized panels were conversion coated according to the sequence outlined in Example 1. As post-treatments were used a 1 gram per liter solution of quebracho extract, and a 1 gram per liter solution of a quebracho extract material sulfited to improve its water solubility in the concentrated state, both of the above adjusted to a pH of 4.5 with hydrofluoric acid. In addition, another post-treatment consisted of a ½ gram per liter quebracho extract solution adjusted to a pH of 4.5 with hydrofluoric acid, and a ¼ gram per liter solution of a quebracho extract adjusted to a pH of 4.5 with hydrofluoric acid to which was added 0.01 grams per liter aluminum fluoride. Panels were dried and painted with an automative body system as in Example 1. The humidity and salt spray resistance of the panels are shown below.

TABLE 4

| Rinse | Salt Spray | Humidity G |
|---|---|---|
| Bisulfited Quebracho - CRS | 4–6 | 10 |
| Bisulfited Quebracho - GALV. | 0–1 | 10 |
| Quebracho - CRS | 1–3 | 10 |
| Quebracho - GALV. | N | 10 |
| Quebracho - ¼ g/l pH 4.5 HF - CRS | 0–2 | 10 |
| Quebracho - ¼ g/l pH 4.5 HF - GALV. | 0–2 | M9 |
| Quebracho - ¼ g/l plus $AlF_3$ pH 4.5 HF - CRS | 0–2 | 10 |
| Quebracho - ¼ g/l plus $AlF_3$ pH 4.5 HF - GALV. | 0–1 | 10 |

These results show that sulfiting the quebracho extract degrades the corrosion resistance of the conversion coated and painted metallic surfaces that had been post-treated with a composition produced therefrom, when compared to the same extract non-sulfited, without harming the humidity resistance thereof. Absence of aluminum fluoride had no effect on either corrosion or humidity resistance, on the other hand.

EXAMPLE 5

SAE 1010 cold rolled mild steel and minimum spangle temper rolled commercial hot dip galvanized panels were conversion coated as described in Example 1 and subjected to post-treatment with a tannin composition consisting of 1 gram per liter of quebracho extract, the pH of which was adjusted downward with hydrofluoric acid. The panels were then painted with the automotive body system described in Example 4 and the humidity and salt spray resistance of the said panel tested as in Example 1. The results of these tests are shown in Table 5.

TABLE 5

| pH | Metal | 336 Hours Salt Spray | 336 Hours Humidity |
|---|---|---|---|
| 7.8 as prepared | CRS | 3–5 | 10 |
| 7.8 as prepared | GALV. | 0–1 | FM9 |
| 7.5 as prepared | CRS | 3–6 | 10 |
| 7.5 as prepared | GALV. | 0–1 | FM9 |
| 5.5 as prepared | CRS | 2–3 | VF9 |
| 5.5 as prepared | GALV. | 0–1 | 10 |
| 4.5 as prepared | CRS | 0–2 | 10 |
| 4.5 as prepared | GALV. | 0–2 | M9 |
| 3.7 as prepared | CRS | 0–3 | 10 |
| 3.7 as prepared | GALV. | 0–1 | 10 |
| Control - Chrome | CRS | 0–1 | VF9.5 |

EXAMPLE 5-A

Following the procedure of Example 5, a tannin composition consisting of 1 g/l of tannic acid (NF powder grade from Penick) was adjusted to a pH of 4.0. The adjusting acids were hydrofluoric acid, phosphoric acid and acetic acid. The panels were then painted with the automotive body system described in Example 1 and the humidity and salt spray resistance of the said panels tested are shown in Table 5-A.

Table 5-A

| pH | Metal | 336 Hours Salt Spray | 336 Hours Humidity |
|---|---|---|---|
| $H_3PO_4$ | CRS | 0–1 | 10 |
| $H_3PO_4$ | GALV. | 1–1 | M9 |
| HF | CRS | 1–2 | VF9 |
| HF | GALV. | 1–1 | FM9 |
| $CH_3COOH$ | CRS | 0–2 | VF9 |
| $CH_3COOH$ | GALV. | 1–3 | M9 |
| Tap Water | CRS | 3–5 | M9 |
| Tap Water | GALV. | 1–2 | D4 |

From Tables 5 and 5-A, it can be seen that the composition of the present invention produces the best results at a pH of less than 6. For the best corrosion resistance, as defined by the aforesaid ASTM B117-61 salt spray test, the pH should be within a narrower range as preferably from a pH of about 3 to a pH of about 6.0. Non-reactive acids other than the above may also be employed.

EXAMPLE 6

SAE 1010 cold rolled mild steel and temper rolled minimum spangle commercial hot dip galvanized panels were conversion coated as described in Example 1 and subjected to a post-treatment with a tannin composition consisting of 1 gram per liter solution of quebracho extract adjusted to a pH of 4.5 with phosphoric acid. The temperature of this post-treatment solution was varied from 85°F. to 145°F. The panels were then dried, painted as in Example 1 and tested in salt spray and humidity as described in Example 1. The results of this testing are shown in Table 6.

TABLE 6

| Spray Time Seconds | Bath Temperature | Metal | 336 Hours Salt Spray | 336 Hours Humidity |
|---|---|---|---|---|
| 15 | 85°F. | CRS | 1–2 | 10 |
| 15 | 85°F. | GALV. | N | 10 |
| 30 | 85°F. | CRS | 2–3 | VF9 |
| 30 | 85°F. | GALV. | 0–1 | 10 |
| 60 | 85°F. | CRS | 1–3 | 10 |
| 60 | 85°F. | GALV. | 0–1 | 10 |
| 120 | 85°F. | CRS | 2–3 | 10 |
| 120 | 85°F. | GALV. | 0–1 | 10 |
| 30 | 104°F. | CRS | 2–3 | 10 |
| 30 | 104°F. | GALV. | N | 10 |
| 30 | 120°F. | CRS | 0–1 | 10 |
| 30 | 120°F. | GALV. | 0–1 | 10 |
| 30 | 140°F. | CRS | 2–4 | 10 |
| 30 | 140°F. | GALV. | N | 10 |
| 30 | 160°F. | CRS | 3–4 | 10 |
| 30 | 160°F. | GALV. | 0–1 | 10 |

These results indicate the usefulness of the composition of this invention over a broad range of temperatures.

EXAMPLE 7

A tannin composition was made by dissolving 250 grams of quebracho extract in 750 grams of water and adjusting the 25% quebracho solution to a pH of 8 with sodium hydroxide in order to put most or all of the quebracho into solution. A post-treatment composition was made from the said 25% concentrated quebracho solution by dissolving four grams of the said solution per liter of water. The pH of this post-treatment solution was then adjusted to 4.5 with phosphoric acid. Panels were processed as described in Example 1, post-treated in the said post-treating solution, dried and painted with the automotive body system as in Example 1, and corrosion and humidity tested as described in Example 1. The results of this testing is shown in Table 7.

TABLE 7

| Rinse | Metal | Salt Spray | Humidity |
|---|---|---|---|
| No NaOH used in preparation | CRS | 0–1 | 10 |
| No NaOH used in preparation | GALV. | 1–1 | VF9 |
| pH of quebracho concentrate at 8.0 | CRS | 0–1 | 10 |
| pH of Quebracho concentrate at 8.0 | GALV. | 1–1 | 10 |

These results show that the utility of the presently described post-treatment is not harmed by the manufacture of a concentration material using an alkali metal hydroxide to adjust the pH in order to solubilize the quebracho therein contained. Such a concentrate has the advantages of being easy to ship and convenient to use to replenish a producing processing tank by pumping the solution to the tank as required.

EXAMPLE 8

Panels were conversion coated as in Example 1 and rinsed in several tannin post-treating compositions, all at a concentration of 1 gram per liter of the tannin extract and all adjusted to a pH of 4.5 with phosphoric acid. Included were technical grade tannic acid, purified tannic acid, and quebracho extract. The said panels were then oven dried as described in Example 1, painted with an automotive body system as described in Example 1 and corrosion and humidity tested as described in Example 1.

TABLE 8

| Aromatic Alkyl Ratio | Metal | 336 Hours Salt Spray | 336 Hours Humidity |
|---|---|---|---|
| 1.5/1 - Technical Tannic Acid | CRS | 7–9 | 10 |
| 1.5/1 - Technical Tannic Acid | GALV. | 0–1 | 10 |
| 3.8/1 - NF Grade Tannic Acid | CRS | 0–1 | 10 |
| 3.8/1 - NF Grade Tannic Acid | GALV. | N | 10 |
| 4.5/1 - Quebracho Extract | CRS | 1–3 | 10 |
| 4.5/1 - Quebracho Extract | GALV. | N | 10 |

The results show that the purity of the tannin used is important particularly to the corrosion resistance of the conversion coated, post-treated and painted metal ware.

EXAMPLE 9

SAE 1010 cold rolled steel panels and temper rolled minimum spangle commercial hot dip galvanized panels were conversion coated on an automotive body pre-treatment line by attaching the panels to automobile bodies being treated therein. The treatment consisted of a minute exposure to a spray alkaline cleaner as described in Example 1, a warm water rinse for one minute, conversion coating by a minute exposure to a zinc phosphating solution as also described in Example 1, a water rinse for one half minute, exposure to a tannin composition spray consisting of 0.6 pound/100 gal. of the quebracho containing concentrate as described in Example 7 adjusted to a pH of 4.2 with the phosphoric acid. This post-treatment was followed by a short exposure to a spray of a solution built from the same concentrate at 0.3 pounds per hundred gallons of water. These compositions were automatically maintained by pumping the concentrate and phosphoric acid at the appropriate rates. For comparison, similar panels had been run at an earlier time in the same production line with the post-treatment being one which contained 0.04% chromic acid at a pH of 4, with a .01% chromic acid at the same pH in the final tank. These panels were dried in the oven on the production line. They were painted with an automotive body paint system consisting of a primer, primer-surface, and top coat and exposed to the salt spray test described in Example 1. The results of 336 hours exposure are shown in Table 9.

TABLE 9

| METAL | POST-TREATMENT | SALT-SPRAY |
|---|---|---|
| Steel | Chromic Acid | 0–1 |
| Galvanized | Chromic Acid | N |
| Steel | quebracho Extract | 0–1[3s] |
| Galvanized | quebracho Extract | 0–1[f] |
| Steel | quebracho Extract | 0–1[2s] |
| Galvanized | quebracho Extract | 0–1 |
| Steel | quebracho Extract | 0–1 |
| Galvanized | quebracho Extract | 0–1[s] |

These results show the utility on the production line of the concentrated composition described in Example 7.

The present invention provides one further advantage in the case of electropainting. Often, the painted surface is rinsed with deionized water while the surface is still wet to remove excess paint. Unfortunately, this rinse has often caused the wet paint film to separate from the metal surface constituting a complete failure of the process. It has been found that, where wet adhesion is a problem, the use of the tannin post-treatment of the present invention prior to painting improves the wet adhesion of the paint over that obtained in the case of a deionized water or chrome+deionized water post-treatment prior to painting.

What is claimed is:

1. In a process for improving the corrosion resistance of a steel or zinc surface by contacting the surface with an aqueous acidic zinc phosphate solution and thereafter painting the surface, the improvement comprising contacting the phosphatized surface with an aqueous chromium-free solution consisting essentially of a vegetable tannin in a concentration of 0.1 to 10 g/l and having a pH of less than 6 and above a value which will cause a degradation of the coating.

2. The process of claim 1 wherein the pH is between 3 and 6.

3. The process of claim 2 wherein the pH is about 4.5.

4. The process of claim 1 wherein the tannin is an extract independently selected from the group consisting of Chinese gall, myrobalan, divi-divi, valonia, sumac, chinchona, mangrove, wattle, eucalyptus, cutch, guebracho, hemlock, mimosa, oak and gambier extracts.

5. The process of claim 1 wherein the tannin is a hydrolyzable tannin.

6. The process of claim 1 wherein the tannin is a condensed tannin.

7. The process of claim 1 wherein the tannin is tannic acid.

8. The process of claim 1 wherein the tannin is quebracho.

9. The process of claim 1 wherein the tannin has an aromatic/alkyl ratio greater than two.

10. The process of claim 9 wherein the aromatic/alkyl ratio ranges from two to five.

11. In a process for preparing a metallic surface for electrodeposition painting wherein said surface is provided with a phosphate conversion coating, rinsed with deionized water to diminish contamination of the paint and thereafter electropainted, the improvement comprising contacting the conversion coated surface with a chromium-free aqueous solution consisting essentially of a vegetable tannin and having a pH of less than 6, and above a value which will cause a degradation of the coating prior to the deionized water rinse.

12. The process of claim 11 wherein said pH is between 3 and 6.

13. The process of claim 11 wherein the tannin concentration is between 0.1 and 10 g/l.

14. A process for the formulation and application of a tannin containing aqueous composition to a phosphatized metallic surface comprising:

1. forming a stable aqueous concentrate by dissolving in water
   a. 5 to 60 wt. % of a vegetable tannin; and b. alkali metal hydroxide in an amount sufficient to yield a pH of at least 7.5 in the concentrate;

2. thereafter diluting the concentrate with water to a tannin concentration not in excess of 10 g/l;
3. establishing a solution pH value of less than 6, by adding an acid if necessary; and
4. contacting the solution of reduced pH with the phosphatized surface.

15. The process of claim 14 wherein the concentrate contains from 15 to 35 wt. % tannin.

16. The process of claim 14 wherein sufficient acid is added to the diluted solution to reduce the pH to a value of about 4.5.

17. The process of claim 15 wherein the acid is selected from the group consisting of phosphoric, hydrofluoric and acetic.

18. In a process for the electrodeposition painting of a metal surface wherein the surface is phosphatized, post-treated, electrodeposition painted, spray rinsed and cured, the improvement comprising contacting the phosphatized metal surface with a chromium-free aqueous solution containing a vegetable tannin and having a pH of less than 6 and above a value which will cause a degradation of the coating.

19. The process of claim 18 wherein the pH of the post-treatment solution is between 3 and 6.

20. The process of claim 18 wherein the tannin concentration is between 0.1 and 10 g/l.

21. The process of claim 18 wherein the tannin is at least one extract selected from the group consisting of Chinese gall, myrobalan, divi-divi, valonia, summac, chinchona, mangrove, wattle, eucalyptus, cutch, quebracho, hemlock, mimosa, oak and gambier extracts.

* * * * *